US005607318A

United States Patent [19]

Wakata et al.

[11] Patent Number: 5,607,318

[45] Date of Patent: Mar. 4, 1997

[54] WATERPROOF CONNECTOR

[75] Inventors: Shigekazu Wakata; Sho Miyazaki, both of Yokkaichi, Japan

[73] Assignee: Sumitomo Wiring Systems, Ltd., Yokkaichi, Japan

[21] Appl. No.: 329,846

[22] Filed: Oct. 27, 1994

[30] Foreign Application Priority Data

Nov. 5, 1993 [JP] Japan ..... 5-064287 U
Nov. 19, 1993 [JP] Japan ..... 5-314571

[51] Int. Cl.[6] ..... H01R 13/52
[52] U.S. Cl. ..... 439/274; 439/275
[58] Field of Search ..... 439/271–283, 439/595, 877, 851

[56] References Cited

U.S. PATENT DOCUMENTS 3,787,796 1/1974 Barr .
4,797,116 1/1989 Isohata et al. ..... 439/274
4,832,616 5/1989 Stein, Sr. et al. .

FOREIGN PATENT DOCUMENTS 1409177 7/1965 France .
51-55392 U 4/1976 Japan .
61-26272 U 2/1986 Japan .
3-50772 U 5/1991 Japan .
3-156867 7/1991 Japan .
88/07775 10/1988 WIPO .

*Primary Examiner*—David L. Pirlot
*Attorney, Agent, or Firm*—Oliff & Berridge

[57] ABSTRACT

A waterproof connector includes a rubber plug stakingly fixable to the leading end portion of a wire to be inserted into a terminal storage chamber formed in a connector housing by a metal terminal engageable with a lance provided in the terminal storage chamber and stakingly fixable to the wire by the metal terminal. The rubber plug has an end terminal plug for closing the rear opening edge of the terminal storage chamber, and an expansion and contraction port on capable of expansion and contraction in the axial direction of the rubber plug.

7 Claims, 5 Drawing Sheets

FIG. 3(A)
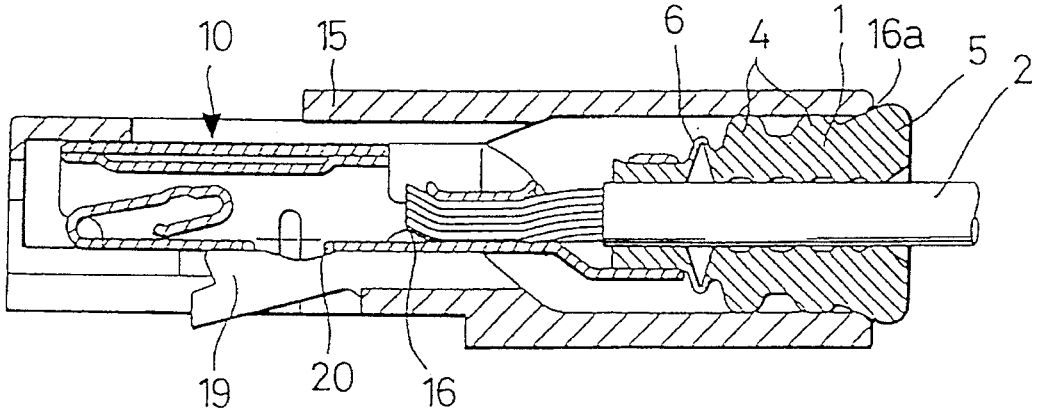
FIG. 3(B)
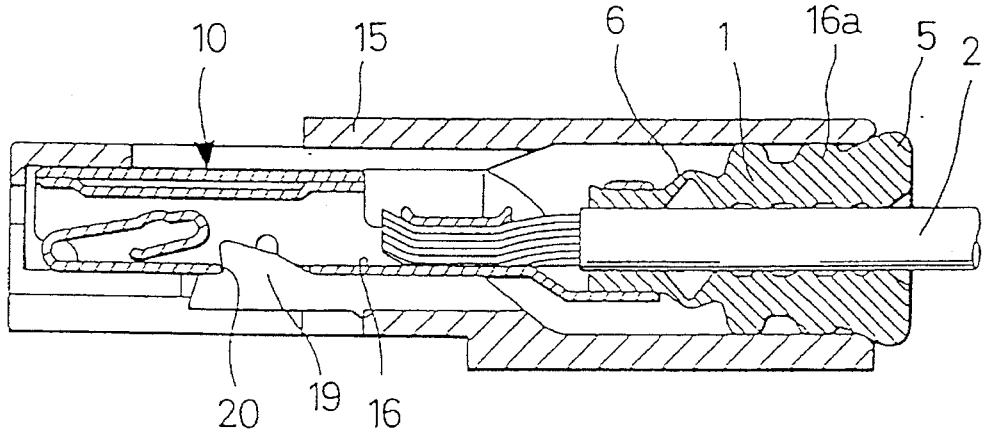
FIG. 4 *PRIOR ART*
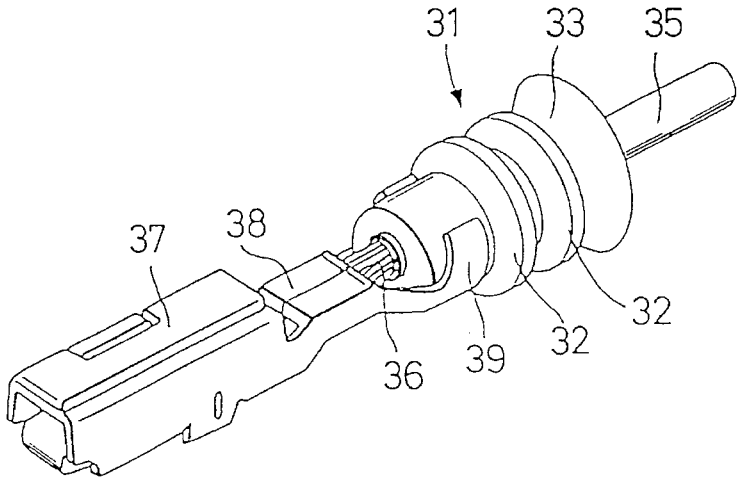

WATERPROOF CONNECTOR

BACKGROUND OF THE INVENTION

1. Field of Invention

The present invention relates to a waterproof connector.

2. Description of Prior Art

In an ordinary connector, a plurality of terminal storage chambers are formed in the interior of a connector housing and terminals are inserted from the rear portion thereof. In the connector of this type, especially, in the connector housing thereof to be used in a place which requires a waterproof condition, waterproofing means is provided in the rear portion of each of the terminals to be inserted into their respective terminal storage chambers. As an example of such technique, there can be taken a technique which is disclosed in Unexamined Japanese Utility Model Publication No. Sho.61-26272. In this technique, cylindrical rubber plugs are respectively fitted with electric wires to be connected to the terminals and the rubber plugs are made to come into contact with the whole peripheries of the inner walls of the terminal storage chambers to thereby secure a sealed condition between the rubber plugs and the terminal storage chambers. More specifically, a metal terminal is fixed to the leading end portion of a wire and a rubber plug having a plurality of pleats on the outer periphery thereof is disposed in the rear of the metal terminal and is staked and fixed by the terminal fitting. And, as the terminal fitting is inserted into a terminal storage chamber formed in a connector housing, the pleats of the rubber plug are made to come into close contact with the peripheral wall of the terminal storage chamber, thereby sealing a clearance between the wire and the peripheral wall of the terminal storage chamber. Further, as a countermeasure to prevent the terminals from being removed from their respective terminal storage chambers, a retainer is mounted to the rear portion of the connector housing. The retainer includes a securing claw, that is, the retainer can be mounted to and removed from the connector housing by means of engagement and disengagement of the securing claw with respect to the housing. Also, in order that the retainer can be inserted in a direction perpendicular to the respective electric wires while avoiding interference with the wires, the retainer includes a plurality of slits which are respectively opened downwardly and are arranged in parallel to one another. Further, a pair of flexible projections are projectingly formed in the opening edges of each of the slits in such a manner that they are opposed to each other with the slit between them. This structure makes it possible not only to press against the rear end of the rubber plug but also to clamp the electric wire from the right and left sides of the wire substantially by one half of the whole periphery of the wire.

In the conventional waterproof connector of the above-mentioned structure, if the rear end face of the rubber plug and the rear opening edge of the terminal storage chamber are not level with each other when the metal terminal is mounted to the housing, then there is a possibility that there can be produced a clearance between the pleats of the rubber plug and the peripheral wall of the terminal storage chamber and standing water can enter the clearance between them although the water does not enter at once. In view of this, the present applicant has proposed in a previous patent application a waterproof connector having an end terminal plug in the rear end portion of the rubber plug for closing the rear opening edge of the terminal storage chamber.

Describing this by use of FIGS. 4 and 5, a rubber plug 31 is formed in a substantially cylindrical shape and includes two flange-like pleats 32 in the axially central portion thereof and, at the same time, includes in the rear end portion thereof an end terminal plug 33 which is used to close the end edge of a rear opening formed in the terminal storage chamber. The end terminal plug 33 is formed in an umbrella shape which fans out outwardly.

In this structure, an electric wire 35 is inserted through a central hole 34 formed in the rubber plug 31 and the portion of the wire 35 projecting out of the front end of the central hole 34 is stripped to expose core wires 36. The thus exposed core wires 36 are fixed by staking a pair of wire barrels 38 provided in a metal terminal 37, while the respective leading end portions of the rubber plug 31 and the covering material of the wire 35 are fixed by staking a pair of insulation barrels 39. In this state, if the wire with the rubber plug 31 mounted thereon is inserted into a terminal storage chamber 42, then a lance 43 provided on the bottom surface of the terminal storage chamber 42 is fitted into and secured to a securing hole 44 formed in the metal terminal 37. In this manner, the pleats of the rubber plug 31 are made to come into close contact with the peripheral wall of the terminal storage chamber 42 and, at the same time, the end terminal plug 33 closes the rear opening edge **42*a* of the terminal storage chamber 42**, thereby being able to perform a positive sealing function.

In the above-mentioned structure, in order to satisfy the securing of the metal terminal 37 and the closure of the rear opening edge **42*a* of the terminal storage chamber 42 by the end terminal plug 33 of the rubber plug 31 at the same time, it is necessary to control the securing hole 44 of the metal terminal 37 and the end terminal plug 33 of the rubber plug 31 in such a manner that a given distance must be always kept between them. However, conventionally, it is known that such dimensional control can vary. As the primary cause of such variable dimensional control, it can be pointed out that the metal terminal is caused to extend in the longitudinal direction thereof when the wire barrel 38 is staked. In this case, the distance between the securing hole 44 and the end terminal plug 33 is increased. Also, as the other cause, it can be imagined that, when the insulation barrels 39 are staked, the setting of the insulation barrels 39 are originally shifted from their respective normal positions with respect to the rubber plug 31 to thereby result in the increased variation of distance between the securing hole 44 and the end terminal plug 33. Or, it can be also imagined that such increased variation of distance between the securing hole 44 and the end terminal plug 33** may be caused by the dimensional errors of the respective components of the waterproof connector.

If the distance between the securing hole 44 and the end terminal plug 33 is increased due to the above causes, then even when the metal terminal 37 is inserted into the terminal storage chamber 42 and is then secured by the lance 43, as shown in FIG. 5, the metal terminal 37 cannot reach the end terminal plug 33 of the rubber plug 31 and the rear opening edge **42*a* of the terminal storage chamber 42. Thus, the metal terminal 37 is not in contact with the rear opening edge 42*a*, thereby spoiling the sealing function of the end terminal plug 33**.

The wire that is drawn out from the connector can be drawn out laterally for reasons of wiring. Then, the wire is given a lateral tensile force, which in turn has an influence on the rubber plug, so that there can be generated a gap between the inner walls of the terminal storage chamber and the rubber plug. In such a structure as disclosed in the above-mentioned publication in which there is provided the flexible projection, the wire is held backwardly of the rubber plug by a distance corresponding to the amount of projection of the flexible projection. Therefore, it can be said in a sense that the influence of the tensile force on the rubber plug can be eliminated to thereby prevent generation of the above gap between the inner walls of the terminal storage chamber and the rubber plug.

However, strictly speaking, such structure is truly effective when the wire is drawn out in a direction where the flexible projection is provided but, according to cases, such projection cannot be provided in a direction perpendicular to this direction. That is, according to the draw-out directions of the wire, there is a possibility that the tensile force of the wire can have an influence on the rubber plug to produce a gap between the rubber plug and the terminal storage chamber, thereby being unable to secure a sealed condition between them.

The present invention aims at eliminating the drawbacks found in the above-mentioned conventional waterproof connector.

SUMMARY OF THE INVENTION

Accordingly, it is a first object of the invention to provide a waterproof connector which can perform the sealing function of the rubber plug positively.

It is a second object of the invention to provide a waterproof connector which can secure a waterproof condition even when an electric wire is drawn out.

In order to achieve the first object, the present invention provides a waterproof connector including a rubber plug stakingly fixable to the leading end portion of a wire to be inserted into a terminal storage chamber formed in a connector housing by a metal terminal engageable with a lance provided in the terminal storage chamber and stakingly fixable to the wire by the metal terminal. The rubber plug has an end terminal plug for closing the rear opening edge of the terminal storage chamber, and an expansion and contraction portion capable of expansion and contraction in the axial direction of the rubber plug.

In order to achieve the second object, the present invention provides a waterproof connector which comprises a housing including therein a plurality of terminal storage chambers for storing their respective terminals, and a retainer removably mounted to the rear portion of the housing and including a plurality of wire insertion grooves, which are respectively cut formed in a direction perpendicular to the draw-out direction of wires to be drawn out through their respective sealing rubber plugs from the terminal storage chambers and into which the wires can be inserted, wherein retainer side hold portions for holding part of the wire along the outer peripheral edge of the wire are projectingly provided in the edge portions of each of the wire insertion grooves and, on the other hand, housing side hold portions for holding the areas of the outer peripheral edge of the wire that are not to be held by the retainer side hold portions are projectingly provided in the rear opening edges of each of the terminal storage chambers.

According to the present invention, since the expansion and contraction portion is provided in the rubber plug, even if there exists any error in a distance between a position where the metal terminal is secured to the lance and the position of the end terminal plug, by expanding or contracting the expansion and contraction portion as demands arise, the distance can be adjusted freely and thus the error can be absorbed.

According to the invention, after the terminals are inserted into the terminal storage chambers of the housing, the retainer is mounted to the housing in such a manner that the wires drawn out from the chambers are respectively inserted in a comb-teeth manner into the retainer through the slits of the retainer. Then, a given area of the outer peripheral edge of each wire is held by the retainer side hold portions, while the remaining areas thereof are held by the housing side hold portions. Therefore, most of the whole periphery of the wire can be held by means of cooperation of the retainer side and housing side hold portions.

The present invention has the following effects. First, because of provision of the expansion and contraction portion in the rubber plug, even if there exists any error in a distance between the securing position of the metal terminal and the end terminal plug of the rubber plug, it is possible to absorb the error and thus to allow the end terminal plug to press against the rear opening edge of the terminal storage chamber all the time, so that a good sealed condition can be secured. Also, the fact that the displacement of the assembling position of the end terminal plug of the rubber plug is allowed eliminates the need that the operation to stake the metal terminal and the operation to fit the rubber plug with the wire must be performed with high accuracy. This can simplify these operations so that the operation efficiency can be enhanced.

Furthermore, the invention provides the following effects: First, since most of the whole periphery of each wire can be held divisional by the two hold portions respectively provided on the retainer and housing sides, even if the wire is drawn out in any angular direction, the wire can be held positively to thereby be able to eliminate the possibility that there can be produced a clearance between the sealing rubber plug and the inner walls of the terminal storage chamber to worsen the sealed condition between them.

BRIEF DESCRIPTION OF THE DRAWINGS

FIG. 3(A) is a section view of the above wire terminal portion, showing the assembling state thereof when the end terminal plug of the rubber plug is displaced forwardly in position; and, FIG. 3(B) is a section view of the same portion after rectified;

FIG. 4 is a perspective view of a terminal portion of a wire according to the conventional waterproof connector;

DETAILED DESCRIPTION OF THE PREFERRED EMBODIMENTS

Figure 1:
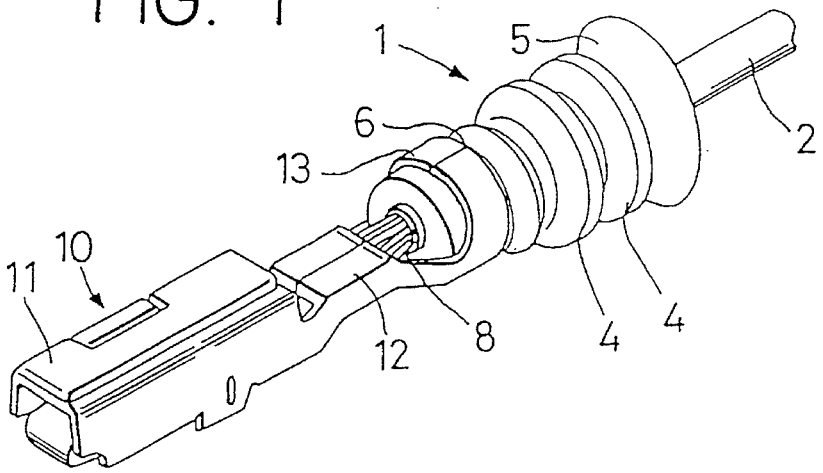
FIG. 1 is a perspective view of a terminal portion of a wire in to a first embodiment of a waterproof connector according to the invention.

Now, description will be given below of a first embodiment of a waterproof connector according to the invention with reference to FIGS. 1 to 3(B).

In the drawings, reference character 1 designates a rubber plug which is formed in a substantially cylindrical shape and includes a central hole 3 through which a wire 2 can be inserted. And, the rubber plug 1 includes two flange-shaped pleats 4 which are respectively formed on the outer periphery of the central portion thereof in the axial direction thereof and are spaced apart from each other in the axial direction thereof. Also, the rubber plug 1 includes in the rear end portion thereof an end terminal plug 5 which is used to close a rear opening formed in a terminal storage chamber 16. The end terminal plug 5 is formed in an umbrella shape the outer peripheral surface of which provides a tapered surface gradually reduced in diameter in a forward direction. The front end portion of the rubber plug 1 can be staked by a pair of insulation barrels 13 included in a metal terminal 10 which will be discussed later.

In the present embodiment, especially, between the portion of the rubber plug 1 to be staked by the insulation barrels 13 and one of the two pleats 4 that is situated in front of the other, there is provided an expansion and contraction portion 6 which is formed in a thin bellows shape having an angle section and can be expanded and contracted in the axial direction of the rubber plug 1. On the other hand, in the central hole 3 of the rubber plug 1, in particular, in a range substantially corresponding to the portion in which the two pleats 4 are provided, there are formed a plurality of circumferential grooves 7 which are used to reduce the contact areas of the rubber plug 1 with the outer periphery of the wire 2 to thereby reduce the frictional resistance between them.

The metal terminal 10 is similar in structure to the conventional one. That is, the metal terminal 10 includes a female terminal portion 11 on the leading end side thereof and, on the rear side thereof, a pair of wire barrels 12 and a pair of insulation barrels 13. And, the wire 2 is inserted from the rear end side thereof, in which the end terminal plug 5 is formed, into the central hole 3 of the rubber plug 1. The portion of the wire 2 that is projected from the front end of the central hole 3 is stripped to thereby expose the core wires 8 thereof. After then, the front portion of the rubber plug 1 is fitted into the insides of the insulation barrels 13 of the metal terminal 10 and the exposed core wires 8 are fitted into the insides of the wire barrels 12, respectively, when the two kinds of barrels 12 and 13 are staked to thereby fix the front portion and the exposed core wires 8 of the wire 2.

On the other hand, a connector housing 15 is also similar in structure to the conventional one. That is, the connector housing 15 includes therein a terminal storage chamber 16 which extends through the connector housing 15 and, on the front surface of the housing, an entrance opening 17 through which a partner male terminal can enter. And, the connector housing 15 includes on the rear side thereof a cylindrical opening 18 which has a diameter slightly smaller than the outside diameter of the pleat 4 of the rubber plug 1 and also through which the metal terminal 10 can be inserted. Also, on the lower surface of the terminal storage chamber 16, there is provided a lance 19 which is normally projecting into the terminal storage chamber 16 and is able to enter and leave the terminal storage chamber 16 due to the elastic deformation of the base end portion of the lance 19. And, on the lower surface of the terminal portion 11 of the metal terminal 10, there is formed a securing hole 20 in which the lance 19 can be fitted.

Next, description will be given below in detail of the operation and effects of the present embodiment structured in the above-mentioned manner. When the metal terminal 10 is inserted into the terminal storage chamber 16 of the connector housing 15 from the rear opening 18, then it elastically deforms the lance 19 outwardly of the terminal storage chamber 16 and the pleats 4 of the rubber plug 1 are elastically reduced in diameter and is pushed into the terminal storage chamber in contact with the inner walls of the opening 18. When the securing hole 20 of the metal terminal 10 comes to a position corresponding to the lance 19, then the lance 19 is projected into the terminal storage chamber 16 due to its restitutive elasticity and is thereby fitted into the securing hole 20, thereby securing the metal terminal 10 in such a manner that it is prevented against removal.

Figure 2A:
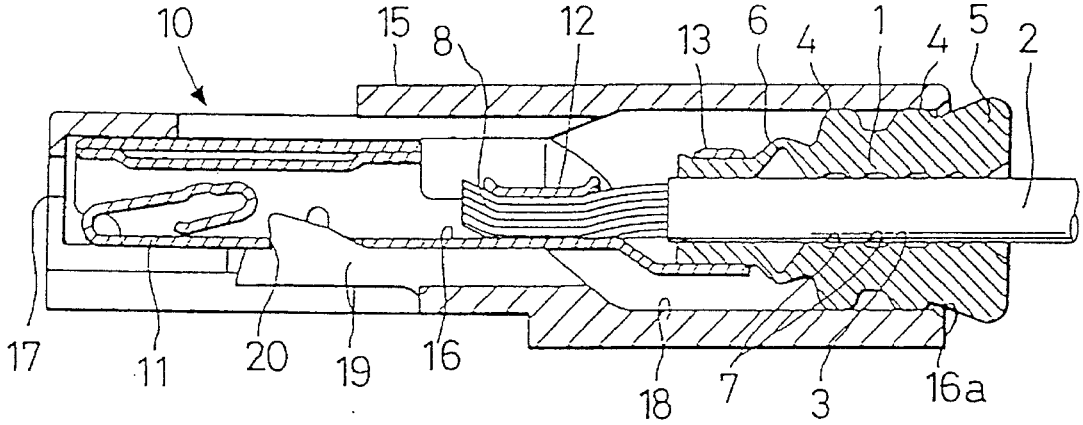
FIG. 2(A) is a section view of the above wire terminal portion, showing the assembling state thereof when an end terminal plug of a rubber plug is displaced backwardly in position; and, FIG. 2(B) is a section view of the same portion after rectified.
Figure 2B:
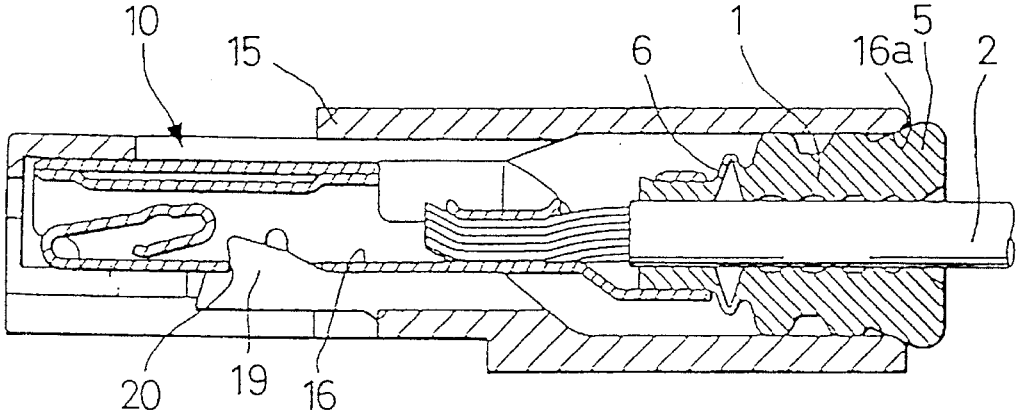
Figure 5:
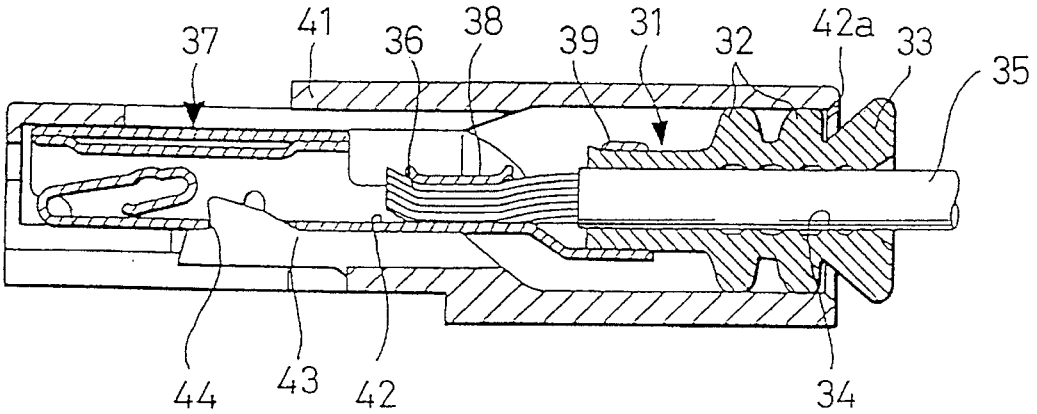
FIG. 5 PRIOR ART
FIG. 5 is a section view of the conventional wire terminal portion, showing the assembled state thereof.

In the above operation, if the end terminal plug 5 is assembled in such a manner that it is displaced backwardly from its normal position, then as shown in FIG. 2(A), there is produced a clearance between the end terminal plug 5 of the rubber plug 1 and the rear opening edge **16*a* of the terminal storage chamber 16. In this case, if the rear end of the rubber plug 1 is pressed, then as shown in FIG. 2(B), the range of the rubber plug 1 extending from the pleats 4 to the end terminal plug 5 is slid on the wire 2 and is pushed into the terminal storage chamber 16 while contracting the expansion and contraction portion 6. The end terminal plug 5 is pressed against the rear opening edge 16*a* of the terminal storage chamber 16, thereby being able to secure a sealing condition between the end terminal plug 5 and the rear opening edge 16*a* of the terminal storage chamber 16**.

On the contrary to the above case, when the lance 19 is not in engagement with the securing hole 20 with the end terminal plug 5 of the rubber plug 1 pressed against the rear opening edge **16*a* of the terminal storage chamber 16 (in a state shown in FIG. 3(A)), if the wire 2 is held by hand and is pushed into the terminal storage chamber, then as shown in FIG. 3(B). The expansion and contraction portion 6 of the rubber plug 1 is expanded. Therefore, the metal terminal 10 together with the wire 2 and the front end portion of the rubber plug 1 can be pushed further into the terminal storage chamber 16 to thereby allow the lance 19 to be engaged with the securing hole 20**.

That is, even if the assembling position of the end terminal plug 5 of the rubber plug 1 varies in the longitudinal direction thereof, simply by expanding or contracting the expansion and contraction portion 6 as demands arise, it is surely possible to achieve the sealing of the rear opening edge **16*a* of the terminal storage chamber 16 by the end terminal plug 5 as well as the securing of the metal terminal 10 by the lance 19**.

Now, the forming position of the expansion and contraction portion of the rubber plug 1 is not limited to the position illustrated in the above-mentioned embodiment but the expansion and contraction portion can be formed at other positions, for example, it can be formed at a position between the two pleats 4, at a position between the rear pleat 4 and the end terminal plug 5, or the like. Also, the present invention can also be applied similarly to a male-type waterproof connector which is arranged to store a male-side metal terminal.

Figure 6:
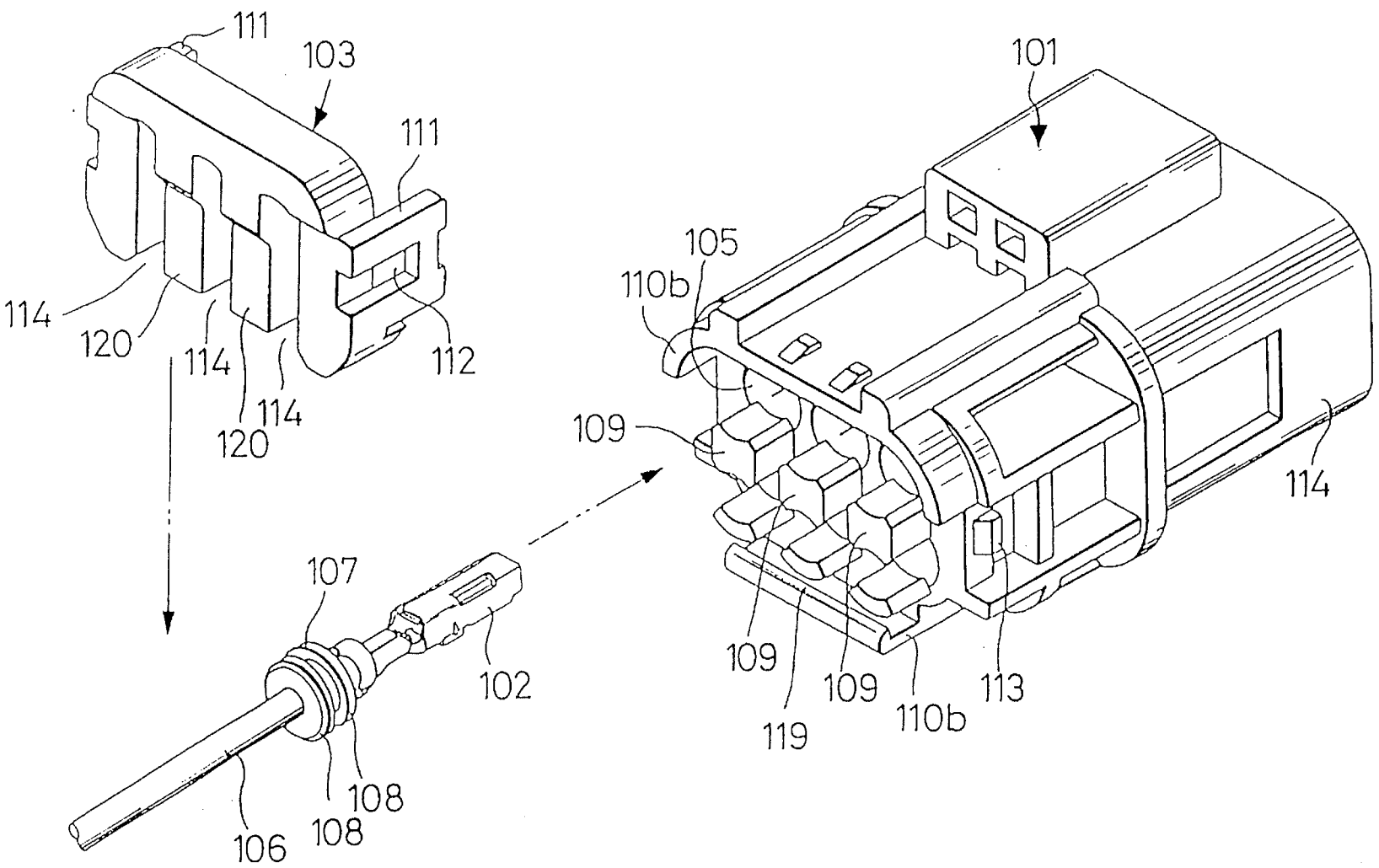
FIG. 6 is an exploded perspective view of a waterproof connector according to the invention.
Figure 10:
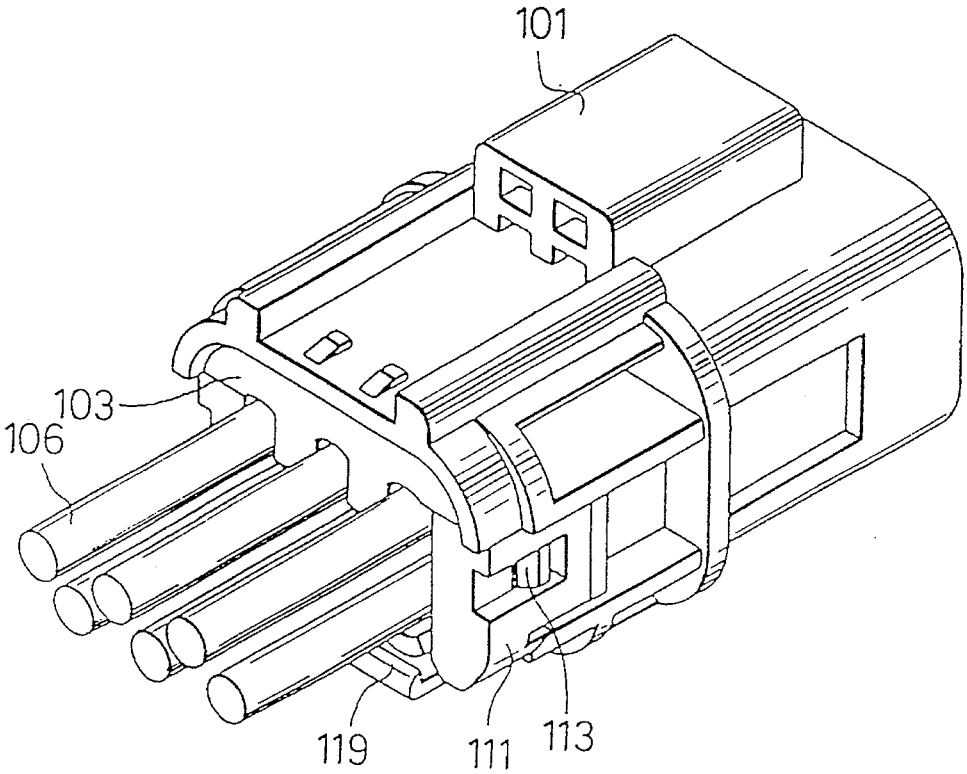
FIG. 10 is a perspective view of the waterproof connector, showing the assembled state of the waterproof connector; and, FIG. 11 is a front view of a retainer employed in the invention, when viewed from the inside thereof.
Figure 11:
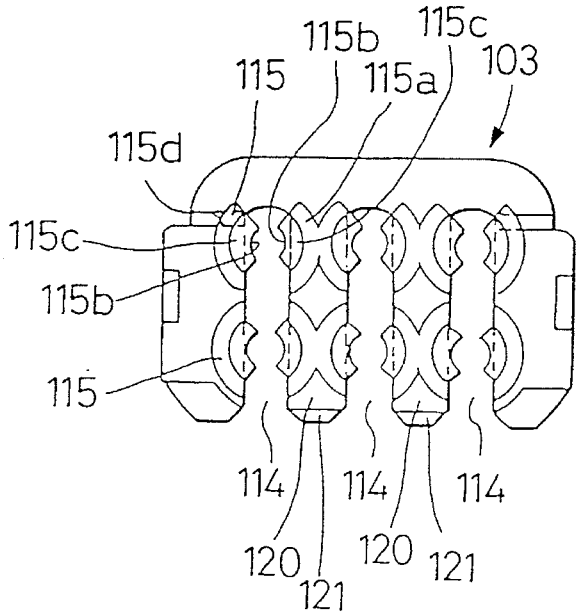

Now, description will be given below in detail of a second embodiment of a waterproof connector according to the invention with reference to the accompanying drawings. FIG. 6 shows an exploded view of the present waterproof connector and, as shown in FIG. 6, the waterproof connector comprises a connector housing 101 and a retainer 103 which is used to prevent removal of terminals 102 respectively to be inserted into the connector housing 101.

In the front portion of the connector housing 101, there is formed an angularly cylindrical hood portion 104 through which the connector housing 101 is fittable with a partner connector housing (not shown). Also, in the interior of the connector housing 101, there are formed a plurality of terminal storage chambers 105 (in FIG. 6, three chambers in line in upper and lower stages) into which terminals 102 can be stored respectively. The terminal 102 is fixed by staking the leading end portion of an electric wire 106, and a sealing rubber plug 107 is fitted with the wire 106 in continuation with the rear portion of the terminal 102. Also, the rubber plug 107 includes a pair of sealing projected portions 108 which are respectively formed integrally in the front and back portion thereof in an annular shape in such a manner that they can be in close contact with the inner walls of the terminal storage chamber 105. The thus structured terminal 102 is inserted from the rear portion (In FIG. 6, from this side) of the terminal storage 105. And, in the rear opening edge of the terminal storage chamber 105, there is disposed a housing side holding portion 109 which is used to hold the portion of the wire 106 to be drawn out.

Figure 8:
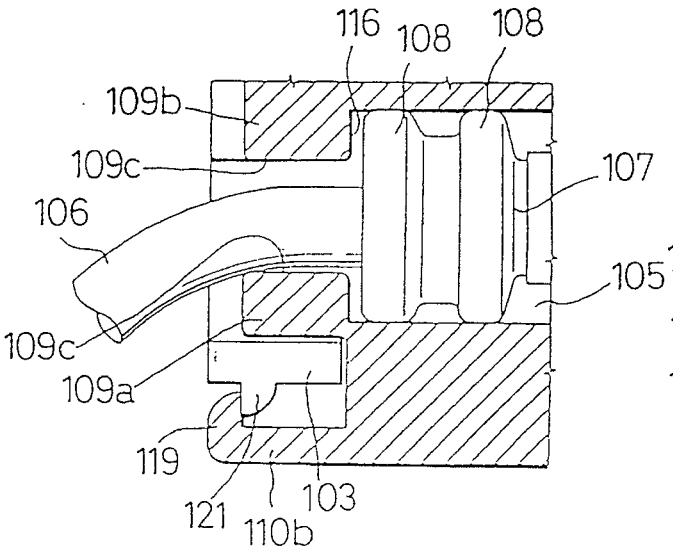
FIG. 8 is a longitudinal section view of the hold portions employed in the waterproof connector.

Each housing side hold portion 109 is formed of a pair of hold pieces 109*a* and 109*b* which are respectively projected upwardly and downwardly in a facing manner from the lower and upper opening edges of the rear portion of each terminal storage chamber 105. However, in the facing upper and lower housing side hold portions 109, the upper and lower intermediate hold surfaces 109*b* respectively forming in common the two hold portions are formed integrally with each other. Also, in each housing side hold portion 109, the inner peripheral surfaces of the two hold pieces 109*a* and 109*b* are so formed as to provide the hold surface 109*c* which has such an arc shape as extends along the outer peripheral surface of the wire 106. In the illustrated embodiment, they are so formed as to be able to hold an angular range of the order of 90° of the outer peripheral surface of the wire 106 symmetrically from above and below. Also, as shown in FIG. 8, the hold surface 109*a* includes a stepped portion 116 between the terminal storage chamber 105 and itself, so that the hold surface 109*c* can approach the wire 106 as much as possible.

Next, referring to the retainer 103, the retainer 103 is formed in such a manner that it can be fitted between upper and lower projected edges 110*a* and 110*b* respectively projected from the upper and lower edges of the rear portion of the connector housing 101. However, the lower projected edge 110*b* of the two projected edges 110*a* and 110*b* is so formed as to be flexible and includes a securing projected edge 119 which is engageable with a claw edge 121 formed in the lower edge of each of division pieces 120 (to be discussed later) formed in the retainer 103.

Also, the retainer 103 includes a pair of flexible securing arms 111 which extend from the two side edges of the retainer 103 and also respectively include window portions 112 which are respectively engageable with projected portions 113 provided on the side surfaces of the connector housing 101. Further, the retainer 103 includes, as shown in FIG. 6, three wire insertion grooves 114 respectively opened downwardly in a comb-teeth manner, and further includes the above-mentioned two division pieces 120 between the wire insertion grooves 114. And, two wires 106 can be inserted respectively into the upper and lower portions of each wire insertion groove 114. Also, each of the wire insertion grooves 114 is so formed as to be in communication with a set of upper and lower terminal storage chambers 105, when the retainer 103 is mounted to the connector housing 101.

Figure 7:
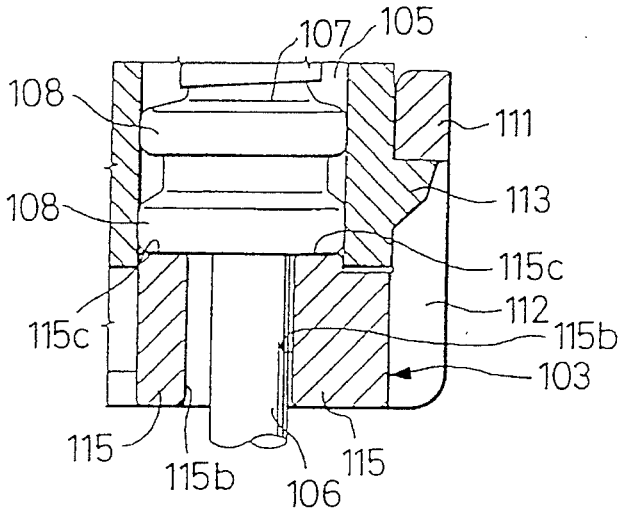
FIG. 7 is a transverse section view of hold portions employed in the waterproof connector.
Figure 9:
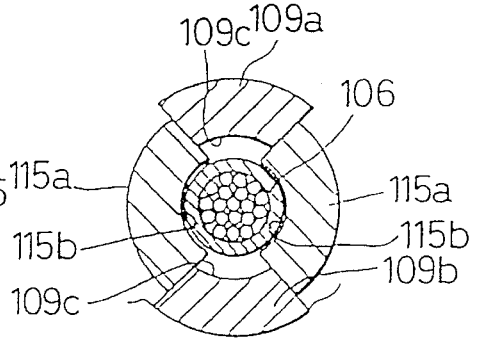
FIG. 9 is a section view of the two hold portions and a wire, showing how the two hold portions hold the wire.

Further, each of the wire insertion grooves 114 includes retainer hold portions 115, two in each of the upper and lower surfaces thereof respectively facing the connector housing 101. Each of the retainer hold portions 115 comprises a pair of right and left hold pieces 115*a* each of which includes in the inner peripheral surface thereof a hold surface 115*b* extending along the outer peripheral surface of the wire 106. That is, the retainer hold portions 115 are so disposed as to be at right angles to the housing side hold portions 109 and, as shown in FIG. 9, in cooperation with the housing side hold portions 109, the retainer hold portions 115 can surround substantially the whole periphery of the wire 106. Also, as shown in FIG. 9, when compared with the housing side hold portions 109, the retainer hold portion 115 are disposed closer to the wire 106 and the hold surfaces thereof are in close contact with the outer peripheral surface of the wire 106. Further, when the retainer 103 is mounted to the connector housing 101, as shown in FIG. 7, the leading end side of the two hold pieces 115*a* of each retainer hold portion 115 are inserted into the terminal storage chamber 105, while the leading end faces of the hold pieces 115*a* are formed as pressure surfaces 115*c* which are respectively pressed against the rear end surface of the rubber plug 107.

Next, description will be given below in detail of the operation and effects of the present embodiment structured in the above-mentioned manner. When assembling the waterproof connector according to the present embodiment, at first, the terminals 102 are inserted into their respective terminal storage chambers 105 from behind and are engaged with elastic securing pieces (not shown) provided in the terminal storage chambers 105, so that the terminals 102 are secured provisionally. At the same time, the rubber plugs 107 are in close contact with the inner walls of their respective terminal storage chambers 105 and the wires 106 are drawn out backwardly from their respective terminal storage chambers 105. Next, sets of upper and lower wires 106 are inserted into the respective wire insertion grooves 114 in the rear portion of the connector housing 101. Next, the retainer 103 is slid toward the connector housing 101 side along the wires 106 and the window portions 112 of the two securing arms 111 are engaged with their corresponding projected portions 113, then the retainer 103 can be fixed to the connector housing 101. Therefore, as described before, the leading end sides of the hold pieces 115*a* of the retainer hold portions 115 are inserted into the terminal storage chambers 105 and the pressure surfaces 115*c* are pressed against the rear end faces of the rubber plugs 107, thereby preventing the terminals 102 from being removed (a secondary securing condition).

Also, when the retainer 103 is mounted, as shown in FIG. 9, the two hold pieces of the housing side hold portion 109 respectively hold the upper and lower areas each of the order of 90° of the wire 106 and the two hold pieces 115*a* of the retainer hold portion 115 respectively hold the right and left areas each of the order of 90° of the wire 106. That is, the housing side and retainer side hold portions 109 and 115 cooperate in holding substantially the whole periphery of the wire 106 and, therefore, even if the wire 106 is pulled in any direction, the holding condition of the wire 106 can be secured. This prevents the tension of the wire 106 from having any influence on the rubber plug 107, so that a sealed condition between the rubber plug 107 and the terminal storage chamber 105 can be maintained.

Although in the second embodiment there are disposed the hold portions 109 and 115 respectively on the connector housing 101 side and the retainer 103 side, from the view point that the outer peripheral surface of the wire 106 is to be surrounded along the whole thereof, the whole of the outer peripheral surface of the wire 106 can also be surrounded by projecting a cylindrical hold portion only on the housing 101 side. However, when compared with this, the separate provision of the two hold portions in the two members as in the present embodiment makes it easier to insert the terminals 102 into the terminal storage chambers as well as to simplify metal molds used to form the members.

Although a preferred structure is illustrated in the second embodiment, the invention is not limited to the illustrated structure but various changes are possible without departing the scope of the patent claim. For example, in the present embodiment, the wires 106 are inserted into the respective wire insertion grooves 114 of the retainer 103 from the upper portions thereof. However, the retainer can also be structured such that the wires are inserted from the side portions thereof.

What is claimed is:

1. A waterproof connector, comprising:

a rubber plug having a fixing portion for sealingly receiving and fixing a wire therein, a slidable portion slidable against said fixing portion in an axial direction of said rubber plug, an end terminal plug provided on said slidable portion and receiving the wire therein, and an expansion/contraction portion allowing for said slidable portion to slide in the axial direction of said rubber plug;

a metal terminal stackingly fixing a core wire of the wire and said fixing portion, said metal terminal having a engaging hole;

a connector housing having a lance engagable with said engaging hole of said metal terminal, and a terminal storage chamber having a rear opening for receiving said metal terminal, the rear opening of said terminal storage chamber being sealed by said end terminal plug;

wherein said end terminal plug is formed in an umbrella shape with an outer peripheral surface that provides a tapered surface gradually reduced in diameter in a forward direction from a diameter greater than the diameter of said rear opening of said connector housing.

2. A waterproof connector according to claim 1, wherein said expansion/contraction portion of said rubber plug has a bellows shape and is arranged between said fixing portion and said slidable portion of said rubber plug.

3. A waterproof connector, comprising:

a rubber plug stackingly fixable to a leading end portion of a wire to be inserted into a terminal storage chamber formed in a connector housing by a metal terminal engageable with a lance provided in the terminal storage chamber and stackingly fixable to the wire by the metal terminal, the rubber plug including an end terminal plug having a diameter greater than the diameter of a rear opening of the terminal storage chamber, wherein said rubber plug further includes an expansion and contraction portion capable of expanding and contracting in an axial direction of said rubber plug.

4. A waterproof connector, comprising:

a plurality of terminals, each terminal receiving a corresponding wire;

a plurality of rubber plugs provided on a rear portion of each terminal, each rubber plug sealing the corresponding wire;

a housing including, a plurality of terminal storage chambers, each terminal storage chamber storing a corresponding terminal, and housing side hold portions, each housing side hold portion projected in a rear opening of a corresponding terminal storage chamber, each housing side hold portion holding the corresponding wire in part; and a retainer removably mounted to a rear portion of said housing, said retainer including, wire insertion grooves, each groove cut in a direction perpendicular to a draw-out direction of each wire to be drawn out through a corresponding rubber plug from the corresponding terminal storage chamber and into which each wire can be inserted, and retainer side hold portions, each retainer side hold portion projected from the edge portion of the corresponding wire insertion groove, each retainer side hold portion holding the corresponding wire in part, wherein each housing side hold portion holds a part of an outer peripheral edge of the corresponding wire, and each retainer side hold portion holds a remainder of the outer peripheral edge.

5. A waterproof connector, comprising:

a housing including a plurality of terminal storage chambers, each terminal storage chamber storing a terminal, and a retainer removably mounted to a rear portion of the housing and including wire insertion grooves which are cut formed in a direction perpendicular to a draw-out direction of a wire to be drawn out through a corresponding sealing rubber plug from each terminal storage chamber and into which the wire can be inserted, wherein retainer side hold portions for holding part of the outer peripheral edge of the wire are projectingly provided in an edge portion of each wire insertion groove and, housing side hold portions projectingly provided in a rear opening of each terminal storage chamber for holding the outer peripheral edge of the wire not held by said retainer side hold portions.

6. A waterproof connector according to claim 4, wherein each rubber plug includes a fixing portion for sealingly receiving and fixing the corresponding wire therein, a slidable portion slidable against said fixing portion in an axial direction of said rubber plug, and an expansion/contraction portion allowing for said slidable portion to slide in the axial direction of said rubber plug, wherein each terminal stackingly fix a core wire of the corresponding wire and said fixing portion, each terminal having a engaging hole.

7. A waterproof connector according to claim 6, further comprising a connector housing including a plurality of lances, each lance engaging the engaging hole of each terminal.

* * * * *